US009461354B2

(12) United States Patent
Günter et al.

(10) Patent No.: US 9,461,354 B2
(45) Date of Patent: Oct. 4, 2016

(54) SINGLE PIECE ANTENNA DEVICE

(71) Applicant: Checkpoint Systems, Inc., Thorofare, NJ (US)

(72) Inventors: Harald Günter, Heppenheim (DE); Peter Schneider, Neckargemuend (DE)

(73) Assignee: CHECKPOINT SYSTEMS, INC., Thorofare, NJ (US)

( * ) Notice: Subject to any disclaimer, the term of this patent is extended or adjusted under 35 U.S.C. 154(b) by 295 days.

(21) Appl. No.: 14/020,017

(22) Filed: Sep. 6, 2013

(65) Prior Publication Data

US 2014/0078015 A1 Mar. 20, 2014

(30) Foreign Application Priority Data

Sep. 17, 2012 (DE) ..... 20 2012 008 852 U

(51) Int. Cl.
*H01Q 1/22* (2006.01)
*H01Q 7/00* (2006.01)
*H01Q 1/40* (2006.01)

(52) U.S. Cl.
CPC ..... *H01Q 1/22* (2013.01); *H01Q 1/2216* (2013.01); *H01Q 1/40* (2013.01); *H01Q 7/00* (2013.01)

(58) Field of Classification Search
CPC ..... H01Q 1/2216; H01Q 1/22; H01Q 1/40; H01Q 7/00
USPC ..... 340/572.7; 343/742, 687, 870, 871, 343/873, 878, 879, 905
See application file for complete search history.

(56) References Cited

U.S. PATENT DOCUMENTS 2,222,438 A * 11/1940 Manson ..... H02G 3/06 174/652
3,622,943 A * 11/1971 Reimer ..... H01R 13/5804 439/472

(Continued)

FOREIGN PATENT DOCUMENTS

DE 2823191 11/1978
DE 68921745 8/1995

(Continued)

OTHER PUBLICATIONS

Ketec, Inc. Shoplifting Prevention Systems; Jan. 15, 2012.*

(Continued)

*Primary Examiner* — Dameon E Levi
*Assistant Examiner* — Ab Salam Alkassim, Jr.
(74) *Attorney, Agent, or Firm* — Nelson Mullins Riley & Scarborough, LLP

(57) ABSTRACT

An antenna device and supports for an antenna. The antenna device includes a plate-like support, having a from, back, and surrounding side face. The surrounding side face has a first groove. The front of the support has at least one second groove. The first antenna cable is located in the first groove and in the second groove. The first and second end regions of the second groove are spaced apart from the surrounding side face. The first end region of the second groove has a first opening to the first groove, and the second end region of the second groove has a second opening to the first groove. The first antenna cable is routed through the first and second openings.

9 Claims, 7 Drawing Sheets

(56) References Cited

U.S. PATENT DOCUMENTS

| | | | | | |
|---|---|---|---|---|---|
| 4,060,294 | A * | 11/1977 | Haworth | E04B 2/7425 | 160/135 |
| 4,135,183 | A | 1/1979 | Heltemes | | |
| 4,416,097 | A * | 11/1983 | Weir | E04B 2/70 | 52/220.2 |
| 4,872,018 | A * | 10/1989 | Feltz | H01Q 7/04 | 340/572.7 |
| 4,972,198 | A * | 11/1990 | Feltz | H01Q 7/04 | 340/572.7 |
| 5,103,235 | A | 4/1992 | Clemens | | |
| D354,060 | S | 1/1995 | Witzky | | |
| 5,497,826 | A * | 3/1996 | Ingram | F24D 13/022 | 165/56 |
| 5,747,734 | A * | 5/1998 | Kozlowski | H02B 1/305 | 174/37 |
| 5,831,211 | A * | 11/1998 | Gartung | A47B 21/06 | 174/498 |
| 6,053,743 | A * | 4/2000 | Mitchell | H01R 9/0515 | 439/578 |
| 6,092,587 | A * | 7/2000 | Ingram | F24D 3/14 | 165/171 |
| D480,388 | S | 10/2003 | Spelman et al. | | |
| 7,687,716 | B2 * | 3/2010 | Pepe | H04Q 1/142 | 174/101 |

FOREIGN PATENT DOCUMENTS

| | | |
|---|---|---|
| DE | 20314836 | 11/2003 |
| DE | 202010000394 | 7/2010 |
| DE | 202012008852 | 12/2013 |
| EP | 0703637 | 3/1996 |
| EP | 703637 A1 * | 3/1996 |
| FR | 2688597 | 9/1993 |
| FR | 2843806 | 2/2004 |
| WO | 2008013876 | 1/2008 |

OTHER PUBLICATIONS

Ketex, Inc. Shoplifting Prevention Systems; Jan. 15, 2012.*

Ketec Clear Vector System,Advancetag Electronic Loss Prevention Specialists, www.advancetag.com.au.

ADT, "Losungen fur den handel", pp. 1-112, ADT Security Deutschland GmbH.

Lucatron, Clear Acrylic EAS System "VELA" VLS-100, Singapore.

NEDAP Retail, Transparent antenna, The Netherlands.

CSS Technologies Development Co., Ltd., "AM-EAS Detection System, MaxAimer Series", http://www.csstech.com.cn, Technical Manual, pp. 1-38, Beijing.

Sofab, "Safety System Anit Shoplifting", Trust Middle East Comp. Ltd.

American Security, Advanced EAS Systems & Accessories.Mono-Antenna Systems, www.amersec.com

* cited by examiner

SINGLE PIECE ANTENNA DEVICE

CROSS-REFERENCE TO RELATED APPLICATION

This application claims the benefit under 35 U.S.C. 119(a) of the earlier filing date of German Application Serial Number 20 2012 008 852.1 filed on Sep. 17, 2012, the entire disclosure of which is hereby incorporated by reference herein as if being set forth in its entirety.

BACKGROUND

The present disclosure relates to an antenna device. An antenna cable may be placed in the grooves of the antenna device so that it is adequately held in place by frictional forces and adequately secured against pull-out by the depth of the grooves.

Electronic merchandise surveillance systems are used to limit the unauthorized removal of goods from a shop. One customary form is the electronic merchandise surveillance system that is placed near the exits of retail shops, libraries, and the like. Electronic merchandise surveillance systems are also used for purposes including process and inventory control, tracking of goods when they pass through a particular system, etc. Regardless of the particular application, this type of electronic merchandise surveillance system generally operates in accordance with the same principle. Goods to be monitored are provided with labels or the like that contain a circuit, in particular a resonant circuit. The circuit reacts to as high frequency field. A transmitter and a transmitting antenna are provided to create this field, and a receiver and a receiving antenna me provided to detect changes in the created field. A system of this nature is known from DE 689 21 745 T2. The electronic merchandise surveillance system has a loop antenna for interacting with labels, each of which contains a resonant circuit. The antenna cable is composed of paired lines.

In pertaining to the device in this disclosure, investigations by the applicant have shown that the antenna cable placed in grooves of the antenna device is adequately held in place by frictional forces and is adequately secured against pull-out by the depth of the grooves. One specific embodiment of the disclosure such as is shown in the Figures, for example, has a number of advantages. As a result of the design of the support, which is formed as a single piece, the antenna device is significantly simpler and thus is more economical to manufacture. For example, there is no need for very long bores, nor is it necessary to assemble the support from multiple parts. The antenna cable can be routed on the carrier by means of the openings without edges of the support being interrupted by grooves. The continuous edges thus achieved significantly reduce the risk of injury.

SUMMARY

The embodiments of the disclosure, and as described below, relate to both an antenna and to supports for an antenna. Embodiments of the disclosure are directed to an antenna device with a plate-like support formed as a single piece and with a first antenna cable of a first antenna loop is provided. The support has a front, a back, and a surrounding side face. The surrounding side face has a first groove. The front has at least one second groove. The first antenna cable is located in the first groove and in the second groove. A first end region of the second groove and a second end region of the second groove are spaced apart from the surrounding side face. The first end region of the second groove has a first opening to the first groove. The second end region of the second groove has a second opening to the first groove. The first antenna cable is routed through the first opening and through the second opening.

Embodiments of the disclosure are directed to a support for an antenna. The support for the antenna is formed as a single piece in a plate shape. The support has a front, back, and a surrounding side face. The surrounding side face has a first groove. The front has at least one second groove. A first end region of the second groove and a second end region of the second groove are spaced apart from the surrounding side face. The first end region of the second groove has a first opening to the first groove. The second end region of the second groove has a second opening to the first groove.

According to one embodiment, the antenna device may have a second antenna cable of a second antenna loop. The surrounding side face may have a third groove. The back of the support may have at least one fourth groove.

According to another embodiment, a third end region of the fourth groove and a fourth and region of the fourth groove may be spaced apart from the surrounding side face. According to one embodiment, the third end region of the fourth groove may have a third opening to the third groove. According to one embodiment, the fourth end region of the fourth groove may have a fourth opening to the third groove.

According to another embodiment, the second antenna cable may be located in the third groove and in the fourth groove. The second antenna cable may be routed through the third opening and through the fourth opening in this design.

According to another embodiment, a length of the second groove may be smaller than a width of the front of the support, wherein the design the length of the groove may extend over a part of the width of the front of the support.

According to another embodiment, two second grooves may be parallel. According to one embodiment, two fourth grooves may be parallel.

According to another embodiment, the first end region may have a greater width than the width of the second groove. According to one embodiment, the second end region may have a greater width than the width of the second groove.

According to another embodiment, the first end region may have as greater depth than the depth of the second groove. According to one embodiment, the second end region may have a greater depth than the depth of the second groove.

According to another embodiment, the first antenna cable may have a larger diameter than the width of the second groove. If the insulation and/or the material of the support is elastic, the first antenna cable can he pressed into the second groove, and is held in the second groove by the force of friction.

According to another embodiment, the first end region and/or the second end region may have a greater width than the diameter of the first antenna cable. Due to the larger width of the end region, the antenna cable can easily he threaded through the first/second end region and the opening formed in the end region.

According to another embodiment, the support may be formed as a single piece of a transparent material. The transparent material may be plastic, for example polymethyl methacrylate—PMMA.

The embodiments described above are especially advantageous, both individually and in combination. All embodiments may be combined with one another. Some possible combinations are explained in the description of the exemplary embodiments from the figures. However, these possibilities of combinations of the embodiments introduced there are not exhaustive.

BRIEF DESCRIPTION OF THE DRAWINGS

The foregoing and other aspects of this disclosure are best understood from the following detailed description when read in connection with the accompanying drawings. For the purpose of illustrating this disclosure, there is shown in the drawings embodiments that are presently preferred, it being understood, however, that this disclosure is not limited to the specific instrumentalities disclosed. Included in the drawings are the Figures.

DETAILED DESCRIPTION OF ILLUSTRATIVE EMBODIMENTS

Figure 1:
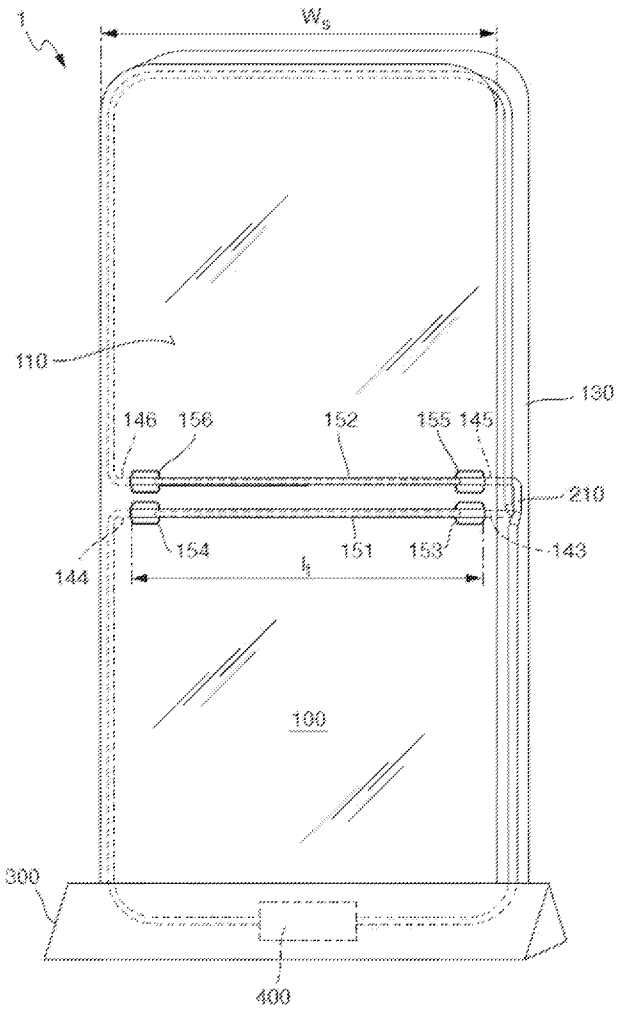
FIG. 1 illustrates a front view of an antenna device.
Figure 2:
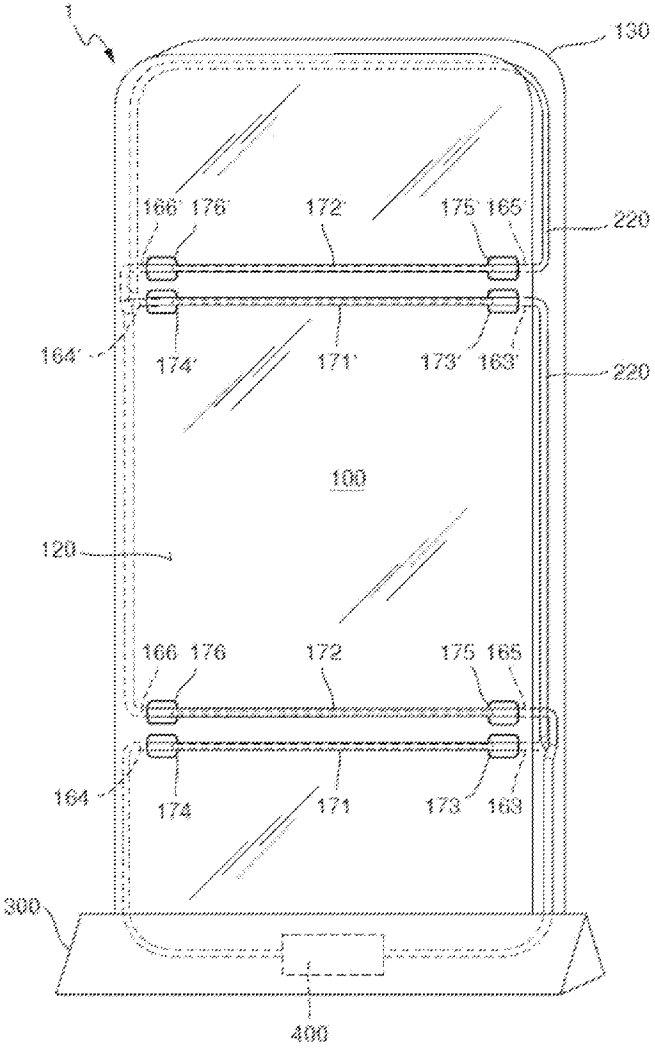
FIG. 2 illustrates a rear view of an antenna device.

An antenna device 1 is shown schematically in a front view in FIG. 1. The antenna device 1 has a support 100 made of a transparent material—in particular plastic. The support 100 in FIG. 1 is plate-like having a plate thickness of, for example, 5 cm. The support 100 is formed as a single part from one piece of material, which is significantly more economical than a support made of multiple parts (not shown). In FIG. 1, the front of the support 110 and some of the surrounding side face 130 are shown schematically. In FIG. 2, in contrast, the back 120 of the support 100 is shown schematically. The front 110 and back 120 of the support 100 are flat in design but not necessarily smooth. The support 100 may be held by a base 300, which may be made of metal or plastic. In one embodiment in FIG. 1, an electronic circuit 400, which may have the function of a so-called reader, may be located in the base 300. The circuit 400 may be configured to read and, if applicable, write to transponders (also called tags; not shown here).

In addition, the antenna device 1 has a first antenna cable 210, which is shown schematically in FIG. 1. The first antenna cable 210 may be connected to the circuit 400. The first antenna cable 210 is routed in the geometric shape of as loop with the aid of the support 100. FIG. 1 schematically shows an example of a geometric shape in the manner of a figure-eight. Depending on the application, other geometric shapes may be used for the antenna function. For the purpose of positioning the first antenna cable 210 on the support 100, the support 100 may have grooves 140, 151, 152. The surrounding side face 130 may have a first groove 140, as is shown in cutaway in FIG. 3 by way of example. The front 110 may have two second grooves 151 and 152. The two second grooves 151, 152 may be parallel in design. The first antenna cable 210 may be arranged as a continuous loop in the first groove 140 and in the two second grooves 151, 152.

Each of the second grooves 151, 152 has a first end region 153, 155 and a second end region 154, 156. Each end region 153, 154, 155, 156 may be spaced apart from the surrounding side face 130. Each of the second grooves 151, 152 may have a length $l_t$ that is smaller than the width $w_s$ of the support 100. The edge of the side face 130 of the support 100 thus is not interrupted by one of the grooves 151, 152. As a result, the risk of injury is significantly reduced. The first end region 153 of the second groove 151 may have a first opening 143 to the first groove 140. In corresponding manner, the other first end region 155 may have the other first opening 145 to the first groove 140. The second end region 154 of the second groove 151 may have a second opening 144 to the first groove 140. In corresponding manner, the other second end region 156 of the second groove 152 may have another second opening 146 to the first groove 140. The first antenna cable 210 may be routed through the first opening 143, 145 and through the second opening 144, 146. Between the two first openings 143 and 145, the antenna cable 210 may cross over itself.

FIG. 2 shows the back 120 of the support 100 with a second antenna cable 220 of a second antenna loop, which may have a different shape from the first antenna loop. In addition to the first groove 140, the surrounding side face 140 may have a third groove 160, which is shown schematically by way of example in a detail view in FIG. 3. The back 120 may have four parallel fourth grooves 171, 172, 171', 172'. The second antenna cable 220 may be arranged in the third groove 160 and in each fourth groove 171, 172, 171', 172'. Each third end region 173, 175, 173', 175' of the associated fourth groove 171, 172, 171', 172' and each fourth end region 174, 176, 174', 176' of the associated fourth groove 171, 172, 171', 172' may be spaced apart from the surrounding side face 130. Consequently, an edge of the surrounding side face 130 is not interrupted by the fourth grooves 171, 172, 171', 172'. The risk of injury when sliding along the edge of the side face is reduced significantly.

Each third end region 173, 175, 173', 175' of the associated fourth groove 171, 172, 171', 172' may have one third opening 163, 165, 163', 165' to the third groove 160. Each fourth end region 174, 176, 174',176' of the associated fourth groove 171, 172, 171', 172' may have one fourth opening 164, 166, 164', 166' to the third groove 160. The second antenna cable 220 may be routed through the third opening 163, 165, 163', 165' and through the fourth opening 164, 166, 164', 166'.

Figure 3:
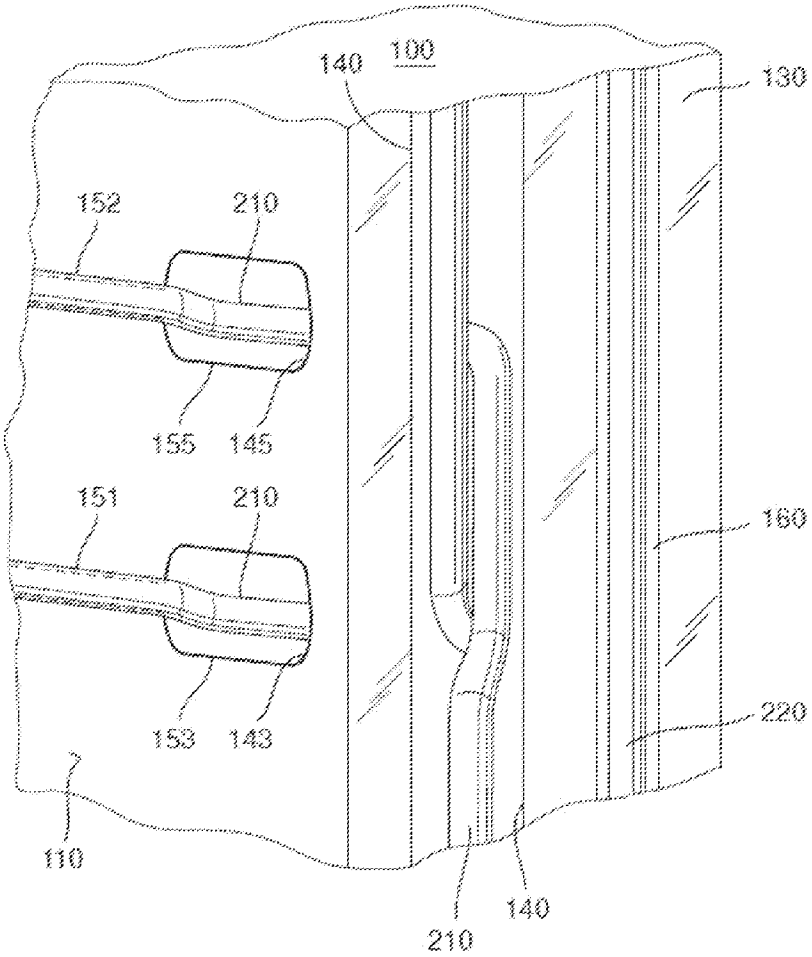
FIG. 3 illustrates a three-dimensional detail view of an antenna device.

For the purpose of routing through the openings 143, 145, 144, 146, 163, 165, 163', 165', 164, 166, 164', 166', the applicable antenna cable 210, 220 may be threaded through the applicable opening 143, 145, 144, 146, 163, 165, 163', 165', 164, 166, 164', 166'. The routed antenna cables 210, 220 are shown schematically in a cutaway view in FIG. 3. FIG. 3 shows a perspective, three-dimensional view of a cutaway portion of the support 100 in the region of the edge between side face 130 and front 110. It is also schematically shown that the first antenna cable 210 in the first groove 140 is routed such that it crosses in the region of the openings 143, 145.

Figure 4:
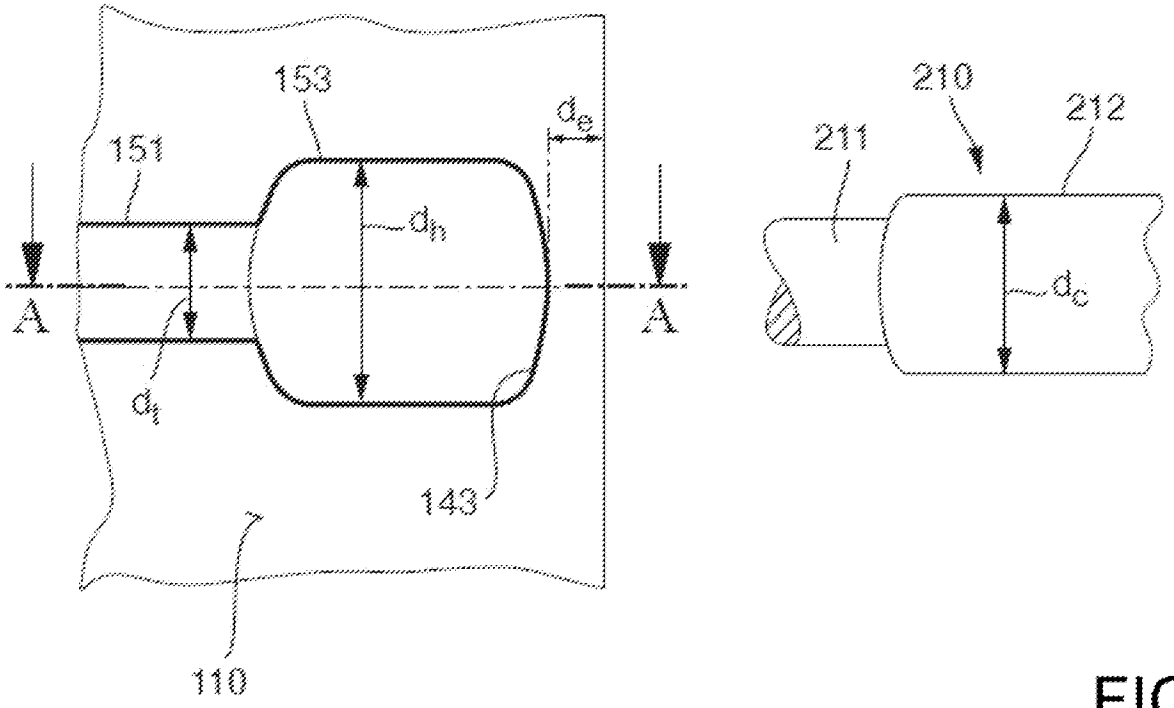
FIG. 4 illustrates a detail view of a cutaway portion of the front of an antenna device.
Figure 5:
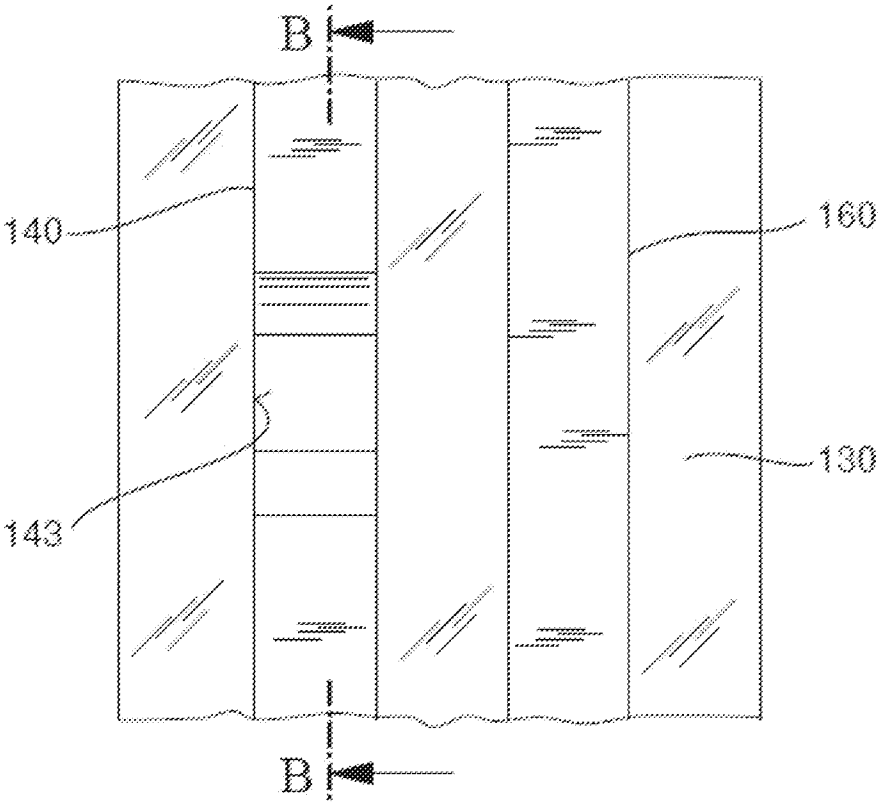
FIG. 5 illustrates a detail view of a cutaway portion of the side face of an antenna device.

In FIG. 4, the first end region 153 of the first groove 151 is shown enlarged in a top view of the front 110 without the antenna cables 210, 220. The end region 153 may be spaced apart from the edge of the side face by the distance $d_e$. The first end region 153 may have a width $d_h$. Outside of the end region 153, the groove 151 may have a groove width $d_t$. According to one embodiment, the width $d_h$ of the end region 153 may be greater than the groove width $d_t$ outside of the end region 153. In addition, FIG. 4 schematically shows the first antenna cable 210 with a stranded metal wire 211 and insulation 212. The antenna cable 210 may have a diameter $d_e$ that is larger than the groove width $d_t$ outside of the first end region 153. By this means, the first antenna cable 210 can be pressed into the first groove 151 while being compressed, so that the first antenna cable 210 adheres in the first groove 151 by the force of friction. In contrast, the width $d_h$ of the first end region 153 may be greater than the diameter $d_c$ of the first antenna cable 210, so that the antenna cable 210 can easily be passed through the first end region 153 and the first opening 143. FIG. 5, however, shows the first groove 140 and the third groove 160 in a top view of the side face 130 without the antenna cables 210, 220. The first opening 143 in a view from the direction of the side face 130 is also shown schematically.

Figure 6:
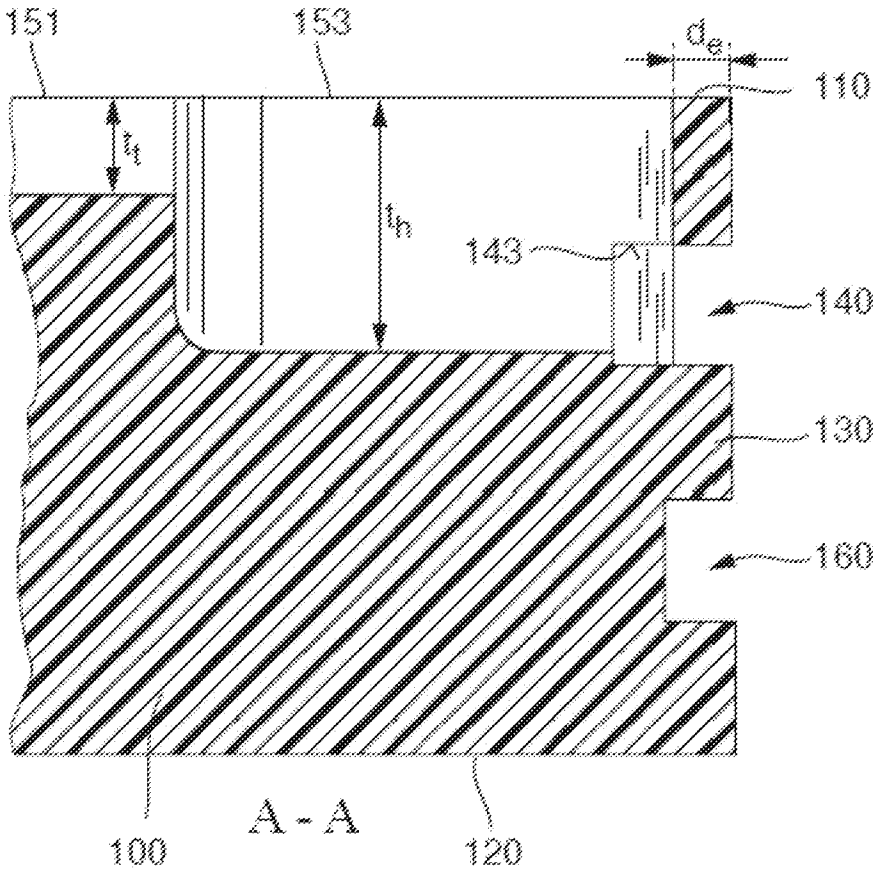
FIG. 6 illustrates a cross-sectional view of an antenna device in a first sectioning plane: and FIG, 7 illustrates a cross-sectional view of an antenna device in a second sectioning plane.

FIG. 6 shows a cross-sectional view along the sectioning plane A-A from FIG. 4. An edge region of the support 100 is shown schematically with the front 110, the back 120, and the side face 130. The sectioning plane A-A here intersects the second groove 151 and its end region 153. It is illustrated in the embodiment that the second groove 151 outside of the end region has a smaller groove depth $t_t$ than the depth $t_h$ in the end region 153. The recess of the end region 153 may intersect the first groove 140, so that the first opening 143 is formed between the end region 153 and the first groove 140. For this purpose, the depth $t_h$ of the end region 153 may be greater than the distance between the first groove 140 and the edge of the front 110 of the support 100. The first antenna cable 210 (not shown in FIG. 6) may thus he routed, starting from the second groove 151, through the first end region 153 of the second groove 151 and through the first opening 143 into the first groove 140. In like manner the end region 153 may be spaced apart from the side face 130 by the distance $d_e$ so that the edge is not interrupted by the end region 153.

Figure 7:
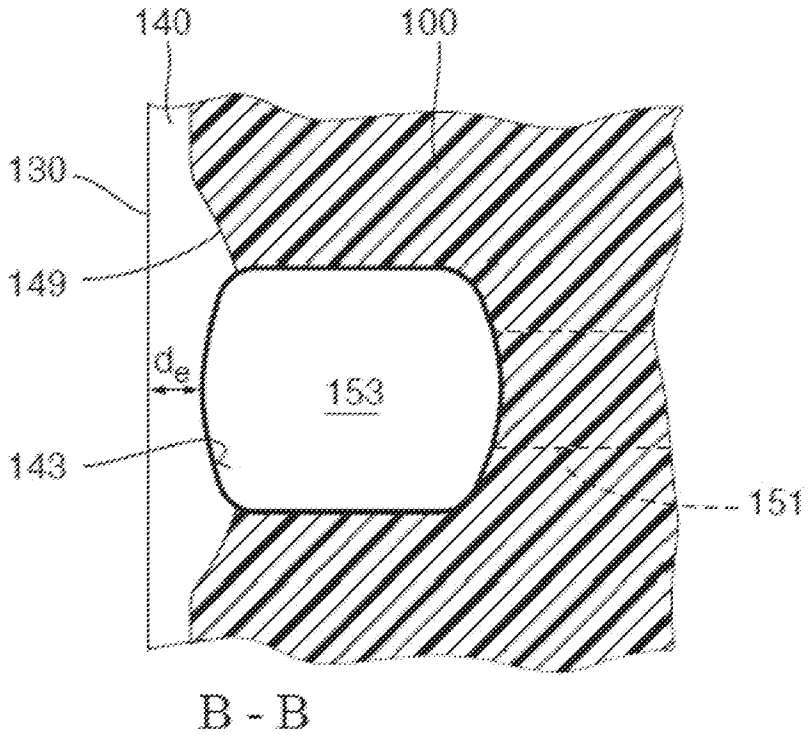

FIG. 7 shows a cross-sectional view along the sectioning plane B-B from FIG. 5. An edge region of the support 100 is shown schematically in FIG. 7 with the side face 130 in the region of the first end region 153 of the second groove 151. The first groove 140 may have a concavity 149 adjacent to the first end region 153. The concavity 149 may increase the bend radius of the first antenna cable 210, which reduces the risk of damage to the insulation 212 and/or the stranded wire 211. The second groove 151 outside of the end region 153 may not be located in the sectioning plane B-B and is merely indicated in FIG. 7 by dashed lines for easier understanding.

The invention is not limited to the embodiments shown in FIGS. 1 through 7. For example, it is possible to design the second groove 151 with a greater depth and to arrange two sections of the first antenna cable 210 together in the second groove 151. It is also possible to implement a different shape for the loop of the antenna cable 210, 220. The functionality of the antenna device 1 from FIG. 1 can be used to particular advantage for reading and, if applicable, writing to transponders in the far field region.

Although this disclosure has been described with reference to exemplary embodiments, it is not limited thereto. Those skilled in the art will appreciate that numerous changes and modifications may be made to the preferred embodiments and that such changes and modifications may be made without departing from the true spirit of this disclosure. It is therefore intended that the appended claims be construed to cover all such equivalent variations as fall within the true spirit and scope of this disclosure.

LIST OF REFERENCE CHARACTERS

1 Antenna device
100 Support
110 Front
120 Back
130 Side face
140, 151, 152, 160, Groove
171, 172, 171', 172'
143, 144, 145, 146, Opening
163, 164, 165, 166,
163', 164', 165', 166'
149 Concavity
153, 154, 155, 156, End region
173, 174, 175, 176,
173', 174', 175', 176'
210, 220 Antenna cable
211 Metal, stranded wire
212 Insulation
300 Base
400 Circuit, reader
$l_t$ Length
$w_s$ Width
$d_c$ Diameter
$d_e$ Distance
$d_h$ Width
$t_h$ Width
$t_h$ Depth
$t_t$ Depth

What is claimed is:

1. An antenna device, comprising:
a plate formed as a single piece; and
a first antenna cable of a first antenna loop;
wherein the plate has a front, a back and a surrounding side face;
wherein the surrounding side face has (a) two vertical sides that are spaced apart and parallel and (b) a first groove that extends along each of the two vertical sides to form a first vertical groove and a second vertical groove;
wherein at least one second groove extends along the front of the plate and is perpendicular to the first vertical groove and the second vertical groove, a length of the at least one second groove being smaller than a shortest distance between the first vertical groove and the second vertical groove;
wherein the first antenna cable is located in the first groove and in the second groove;
wherein a first end region of the second groove and a second end region of the second groove are spaced apart from the surrounding side face and the first groove;
wherein the first end region of the second groove has a first opening to the first groove;
wherein the second end region of the second groove has a second opening to the first groove; and
wherein the first antenna cable is routed through the first opening and through the second opening.

2. The antenna device of claim 1, wherein the at least one second groove comprises two second grooves that are parallel.

3. The antenna device of claim 1, wherein the first end region has a greater width than a width of the second groove; or wherein the second end region has a greater width than the width of the second groove.

4. The antenna device of claim 1, wherein the first end region has a greater depth than a depth of the second groove; or wherein the second end region has a greater depth than the depth of the second groove.

5. The antenna device of claim 1, wherein the first antenna cable has a larger diameter than a width of the second groove.

6. The antenna device of claim 1, wherein the first end region has a greater width than a diameter of the first antenna cable; or wherein the second end region has a greater width than the diameter of the first antenna cable.

7. The antenna device of claim 1, wherein the plate is formed as a single piece from a transparent material.

8. The antenna device of claim 1, further comprising:

a second antenna cable of a second antenna loop, wherein the surrounding side face has a third groove;

wherein the back has at least one fourth groove;

wherein the second antenna cable is located in the third groove and in the fourth groove;

wherein a third end region of the fourth groove and a fourth end region of the fourth groove are spaced apart from the surrounding side face;

wherein the third end region of the fourth groove has a third opening to the third groove;

wherein the fourth end region of the fourth groove has a fourth opening to the third groove; and wherein the second antenna cable is routed through the third opening and through the fourth opening.

9. A support for an antenna, comprising:

a front;

a back; and a surrounding side face;

wherein the support is a plate formed as a single piece;

wherein the surrounding side face (a) is exposed, (b) has two vertical sides that are spaced apart and parallel, and (c) has a first groove that extends along each of the two vertical sides to form a first vertical groove and a second vertical groove;

wherein at least one second groove extends along the front of the support and is perpendicular to the first vertical groove and the second vertical groove, a length of the at least one second groove being smaller than a shortest distance between the first vertical groove and the second vertical groove;

wherein a first end region of the second groove and a second end region of the second groove are spaced apart from the surrounding side face and the first groove;

wherein the first end region of the second groove has a first opening to the first groove; and wherein the second end region of the second groove has a second opening to the first groove.

* * * * *